US006869170B2

(12) United States Patent
Shimada et al.

(10) Patent No.: US 6,869,170 B2
(45) Date of Patent: Mar. 22, 2005

(54) INK-JET RECORDING HEAD HAVING A VIBRATION PLATE PREVENTED FROM BEING DAMAGED AND INK-JET RECORDING APPARATUS FOR USING THE SAME

(75) Inventors: Masato Shimada, Nagano-ken (JP); Yoshinao Miyata, Nagano-ken (JP); Hiroyuki Kamei, Nagano-ken (JP); Tetsushi Takahashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/977,197

(22) Filed: Oct. 16, 2001

(65) Prior Publication Data

US 2002/0085065 A1 Jul. 4, 2002

(30) Foreign Application Priority Data

Oct. 16, 2000 (JP) ..... 2000-315607
Dec. 13, 2000 (JP) ..... 2000-379199
Dec. 20, 2000 (JP) ..... 2000-386891

(51) Int. Cl.[7] ..... B41J 2/045
(52) U.S. Cl. ..... 347/68; 347/70; 347/71
(58) Field of Search ..... 347/68, 70, 71

(56) References Cited

FOREIGN PATENT DOCUMENTS

| | | | | |
|---|---|---|---|---|
| EP | 0 899 107 A2 | | 3/1999 | |
| EP | 0 903 234 A2 | * | 3/1999 | ..... B41J/2/14 |
| EP | 0 943 437 A1 | | 9/1999 | |
| EP | 0 963 846 A2 | | 12/1999 | |
| EP | 0 976 560 A2 | * | 2/2000 | ..... B41J/2/14 |
| JP | 05-261921 | | 10/1993 | |
| JP | 5-286131 | | 11/1993 | ..... B41J/2/045 |
| JP | 10-081016 | | 3/1998 | |
| JP | 10-217466 | | 8/1998 | |
| JP | 11-070654 | | 3/1999 | |
| JP | 11-151815 | | 6/1999 | |
| JP | 11-157062 | | 6/1999 | |
| JP | 2000-272125 | | 10/2000 | |
| JP | 2000-326503 | | 11/2000 | |

* cited by examiner

*Primary Examiner*—Stephen D. Meier
*Assistant Examiner*—Lam S Nguyen
(74) *Attorney, Agent, or Firm*—Sughrue Mion, PLLC

(57) ABSTRACT

Provided is an ink-jet recording head that prevents a vibration plate thereof from damage attributed to drive of a piezoelectric element, and an ink-jet recording apparatus. There are provided within a region facing the pressure generating chamber, a piezoelectric active portion, and a piezoelectric non-active portions, the piezoelectric non-active portions being provided on both end portions of the piezoelectric active portion in a longitudinal direction thereof. An electrode wiring is drawn out of an upper electrode which is provided on one end portion in the longitudinal direction of the pressure generating chamber. There is also provided a protection layer on the other end portion in the longitudinal direction of the pressure generating chamber for protecting the vibration plate. Rigidity of the vibration plate is thereby increased.

24 Claims, 11 Drawing Sheets

INK-JET RECORDING HEAD HAVING A VIBRATION PLATE PREVENTED FROM BEING DAMAGED AND INK-JET RECORDING APPARATUS FOR USING THE SAME

BACKGROUND OF THE INVENTION

The present invention relates to an ink-jet recording head for ejecting ink droplets by displacing a piezoelectric element, in which a vibration plate constitutes a part of a pressure generating chamber communicating with a nozzle orifice that ejects ink droplets, and the piezoelectric element is provided via the vibration plate. Moreover, the present invention relates to an ink-jet recording apparatus.

As an ink-jet recording head for ejecting ink droplets from a nozzle orifice, in which a vibration plate constitutes a part of a pressure generating chamber communicating with a nozzle orifice that ejects ink droplets, and the vibration plate is deformed by the piezoelectric element to pressurize ink in the pressure generating chamber, the following two types have been put into practical use. One uses a piezoelectric actuator of a longitudinal vibration mode, which stretches and contracts in an axial direction of the piezoelectric element; the other uses a piezoelectric actuator of a flexural vibration mode.

The former ink-jet recording head can change the volume of the pressure generating chamber by allowing an end face of the piezoelectric element to abut against the vibration plate, thus making it possible to manufacture a head suitable for high density printing. On the contrary, a difficult process, in which the piezoelectric element is cut and divided into a comb teeth shape to make it coincide with an array pitch of the nozzle orifice, and an operation of positioning and fixing the cut and divided piezoelectric element onto the pressure generating chamber are required for the former ink-jet recording head, thus there is a problem of a complicated manufacturing process.

Meanwhile, the latter ink-jet recording head has had an advantage that the piezoelectric element can be fixedly installed into the vibration plate in relatively simple steps of adhering a green sheet of a piezoelectric material to the vibration plate so as to fit the green sheet to a shape of the pressure generating chamber and of sintering the same. However, the latter ink-jet recording head has been involved in a problem of difficulty in a high density array of the pressure generating chambers, which originates from a need of a certain amount of area because of utilization of the flexural vibration.

In order to solve a disadvantage of the latter ink-jet recording head, as disclosed in Japanese Patent Laid-Open No. Hei 5(1993)-286131, an ink-jet recording head has been proposed, in which a piezoelectric material layer having an even thickness is formed over the entire surface of a vibration plate by a film growth technology, and this piezoelectric material layer is cut and divided by a lithography method so that each piece of the layer can correspond to a shape of each pressure generating chamber, thus forming each piezoelectric element so as to be independent for each pressure generating chamber.

However, the above-described ink-jet recording head has been involved in a problem that cracks and the like occur in the vibration plate due to repeated deformations by driving the piezoelectric element. Particularly, a region of the vibration plate near an end portion of the pressure generating chamber in its longitudinal direction is apt to cause damage such as cracking because of a large amount of deformation due to the drive of the piezoelectric element.

SUMMARY OF THE INVENTION

The present invention is made in consideration of such circumstances, and an object of the present invention is to provide an ink-jet recording head capable of preventing damage to of a vibration plate due to the driving of a piezoelectric element, and to provide an ink-jet recording apparatus.

In order to solve the foregoing problem, a first aspect of the present invention is an ink-jet recording head including a pressure generating chamber that communicates with a nozzle orifice and a piezoelectric element having a lower electrode, a piezoelectric layer and an upper electrode being provided in a region corresponding to the pressure generating chamber via a vibration plate, wherein there are provided within a region facing the pressure generating chamber a piezoelectric active portion as a substantial drive portion of the piezoelectric element and a piezoelectric non-active portions having the piezoelectric layer continuous from the piezoelectric active portion but not being substantially driven the piezoelectric non-active portions being provided on both end portions of the piezoelectric active portion in a longitudinal direction thereof, electrode wiring drawn out of the upper electrode is provided on one end portion in the longitudinal direction of the pressure generating chamber, and there is provided a protection layer on the other end portion in the longitudinal direction of the pressure generating chamber for protecting the vibration plate being provided in a region facing an end portion of the pressure generating chamber and in region facing an end portion of the piezoelectric layer within the region facing the pressure generating chamber.

In the first aspect, rigidity of the vibration plate at the other end portion in the longitudinal direction of the pressure generating chamber is enhanced by the protection layer. In this way, damage to the vibration plate attributed to deformation due to drive of the piezoelectric element can be prevented.

A second aspect of the present invention is the ink-jet recording head according to the first aspect, wherein said piezoelectric layer has crystals subjected to a priority orientation.

In the second aspect, the crystals therein have preferential orientation as a result of the piezoelectric layer being grown by a thin-film process.

A third aspect of the present invention is the ink-jet recording head according to the second aspect, wherein said piezoelectric layer has crystals shaped in a columnar shape.

In the third aspect, the crystals have columnar shapes as a result of the piezoelectric layer being grown by the thin-film process.

A fourth aspect of the present invention is the ink-jet recording head according to any one of the first to third aspects, wherein a film thickness of said piezoelectric layer ranges from 0.5 to 3 $\mu$m.

In the fourth aspect, the head can be scaled down by relatively thinning the film thickness of the piezoelectric layer.

A fifth aspect of the present invention is the ink-jet recording head according to any one of the first to fourth aspects, wherein the protection layer is provided so as to cover a region facing a corner portion of the pressure generating chamber.

In the fifth aspect, rigidity of the vibration plate at the other end portion in the longitudinal direction of the pressure generating chamber can be effectively enhanced.

A sixth aspect of the present invention is the ink-jet recording head according to any one of the first to fifth aspects, wherein the protection layer is composed of the same layer as the electrode wiring.

In the sixth aspect, the protection layer can be formed relatively easily.

A seventh aspect of the present invention is the ink-jet recording head according to the sixth aspect, wherein the protection layer is provided so as to cover the end portion in the longitudinal direction of the piezoelectric non-active portion.

In the seventh aspect, rigidity of the vibration plate in a region facing the end portion of the piezoelectric layer of the piezoelectric non-active portion can be effectively enhanced.

An eighth aspect of the present invention is the ink-jet recording head according to sixth or seventh aspects, wherein the protection layer is provided as to extend beyond a boundary of the piezoelectric active portion and the piezoelectric non-active portion.

In the eighth aspect, stress at the boundary of the piezoelectric element between the piezoelectric active portion and the piezoelectric non-active portion is suppressed by the protection layer during the drive of the piezoelectric element, thus preventing the piezoelectric layer from being damage.

A ninth aspect of the present invention is the ink-jet recording head according to any one of the first to eighth aspects, wherein the protection layer possesses higher rigidity than the lower electrode.

In the ninth aspect, rigidity of the vibration plate in the regions facing the both end portions in the longitudinal direction of the pressure generating chamber can be surely enhanced.

A tenth aspect of the present invention is the ink-jet recording head according to any one of the first to ninth aspects, wherein the protection layer is also provided one end portion of the pressure generating chamber.

In the tenth aspect, since rigidity of the vibration plate in the regions facing the both end portions in the longitudinal direction of the pressure generating chamber is increased, durability and reliability can be surely enhanced.

An eleventh aspect of the present invention is the ink-jet recording head according to the tenth aspect, wherein the electrode wiring doubles as the protection layer.

In the eleventh aspect, since the electrode wiring doubles as the protection layer, a structure can be simplified whereby a manufacturing cost therefore can be reduced.

A twelfth aspect of the present invention is the ink-jet recording head according to any one of the first to eleventh aspects, wherein the lower electrode is formed across a plurality of piezoelectric elements, a lower-electrode-removal portion is formed at each of the pressure generating chambers by removing the lower electrode on at least the end portion of the lower electrode opposite to the electrode wiring of the pressure generating chamber, and the protection layer is formed only within the lower-electrode-removal portion.

In the twelfth aspect, since the lower-electrode-removal portion is provided in each of the pressure generating chambers, an increase in resistivity of the lower electrode is suppressed, whereby voltage can be favorably applied to the piezoelectric element.

A thirteenth aspect of the present invention is the ink-jet recording head according to the twelfth aspect, wherein the lower-electrode-removal portion has an approximately rectangular shape.

In the thirteenth aspect, the lower-electrode-removal portion can be readily formed by etching.

A fourteenth aspect of the present invention is the ink-jet recording head according to any one of claims 1 to 11, wherein the lower electrode is formed across a plurality of piezoelectric elements, and the lower-electrode-removal portion is formed continuously over a region corresponding to the plurality of pressure generating chambers by removing the lower electrode on at least the end portion of the lower electrode opposite to the electrode wiring of the pressure generating chamber.

In the fourteenth aspect, the lower-electrode-removal portion can be readily formed by etching.

A fifteenth aspect of the present invention is the ink-jet recording head according to any one of the first to fourteenth aspects, wherein at least the piezoelectric layer constituting the piezoelectric element is formed independently within the region facing the pressure generating chamber.

In the fifteenth aspect, an amount of displacement of the vibration plate attributed to drive of the piezoelectric element is increased.

A sixteenth aspect of the present invention is the ink-jet recording head according to any one of the first to fourteenth aspects, wherein the piezoelectric non-active portion on at least the other end portion in the longitudinal direction of the pressure generating chamber is provided in a manner extending to the outside of the region facing the pressure generating chamber to protect the vibration plate by eliminating the end portion of the piezoelectric layer within the region facing the pressure generating chamber, and a region of the piezoelectric non-active portion provided by extending to the outside of the region facing the pressure generating chamber constitutes a part of the protection layer.

In the sixteenth aspect, rigidity of the vibration plate in the region facing the end portion in the longitudinal direction of the pressure generating chamber is significantly enhanced, thus preventing the vibration plate from damage.

A seventeenth aspect of the present invention is the ink-jet recording head according to the sixteenth aspect, wherein at least a width in the vicinity of a portion of the piezoelectric layer constituting the piezoelectric non-active portion, which traverses a boundary of the end portion in the longitudinal direction of the pressure generating chamber and the peripheral wall, is wider than a width of the pressure generating chamber.

In the seventeenth aspect, since the vibration plate in a boundary portion of the end portion in the longitudinal direction of the pressure generating chamber and the peripheral wall is completely covered with the piezoelectric non-active portion being the protection layer, rigidity of the vibration plate is more surely enhanced.

An eighteenth aspect of the present invention is the ink-jet recording head according to one of the sixteenth and seventeenth aspects, wherein at least the piezoelectric non-active portion on the side of the other end portion in the longitudinal direction of the pressure generating chamber is formed by removing the upper electrode.

In the eighteenth aspect, the piezoelectric non-active portion can be readily formed by removing the upper electrode.

A nineteenth aspect of the present invention is the ink-jet recording head according to one of the sixteenth and seventeenth aspects, wherein at least the piezoelectric non-active portion on the side of the other end portion in the longitudinal direction of the pressure generating chamber is formed by removing the lower electrode.

In the nineteenth aspect, the piezoelectric non-active portion can be readily formed by removing the lower electrode, and an electrode constituent layer constituting the protection layer can be readily formed.

A twentieth aspect of the present invention is the ink-jet recording head according to any one of the first to nineteenth aspects, wherein the pressure generating chamber is formed on a silicon single crystal substrate by anisotropic etching, and each of the layers of the piezoelectric element is formed by thin-film and lithography methods.

In the twentieth aspect, the pressure generating chambers can be formed relatively easily and accurately with high density.

A twenty-first aspect of the present invention is an ink-jet recording apparatus comprising the ink-jet recording head according to any one of the first to the twentieth aspects.

In the twenty-first aspect, an ink-jet recording head with enhanced durability and reliability thereof can be achieved.

DETAILED DESCRIPTION OF THE PREFERRED EMBODIMENTS

Embodiments of the present invention will be described below with reference to the accompanying drawings.

(Embodiment 1)

Figure 1:
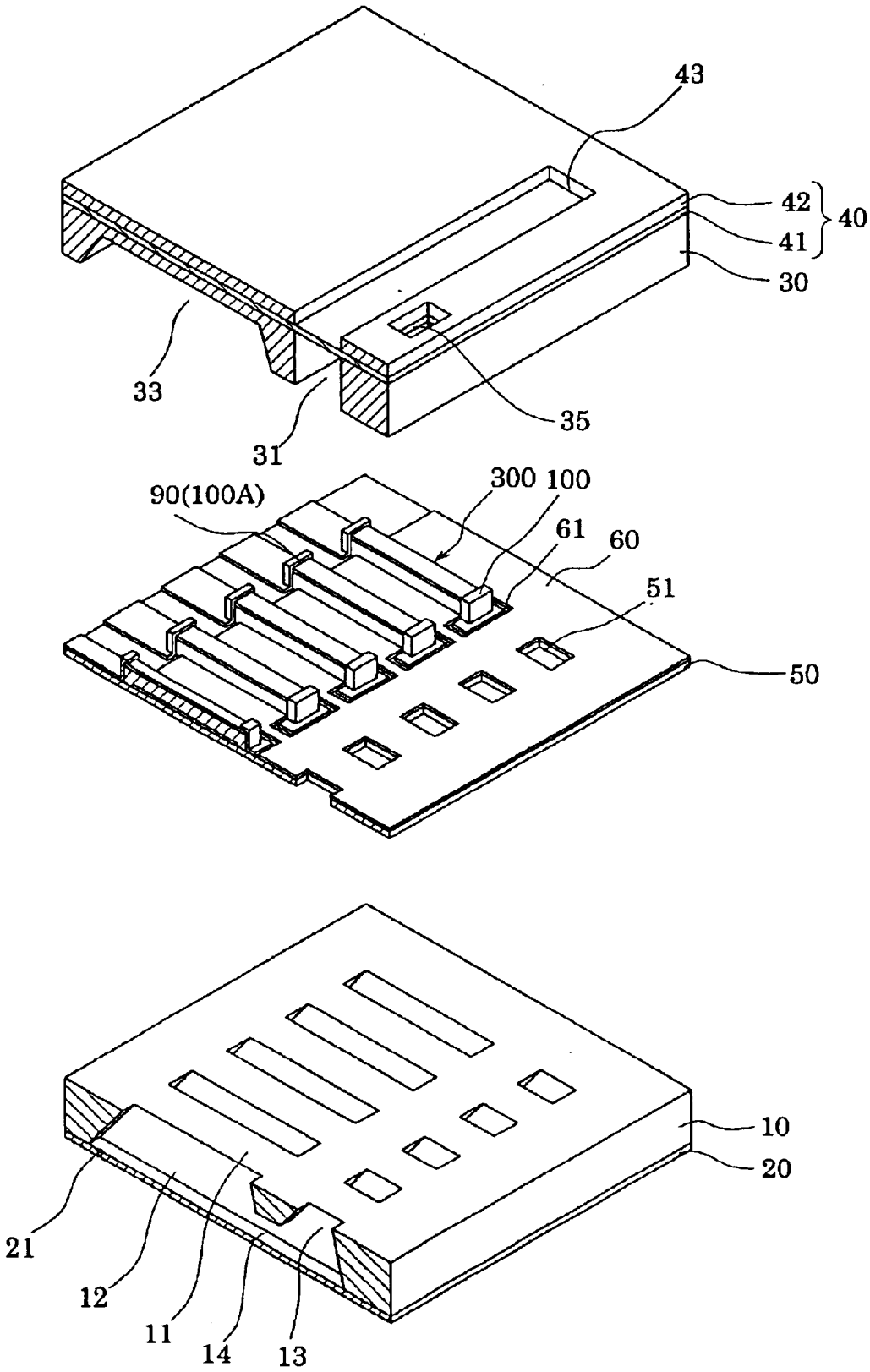
FIG. 1 is a exploded perspective view of an ink-jet recording head according to a first embodiment of the present invention.
Figure 2A:
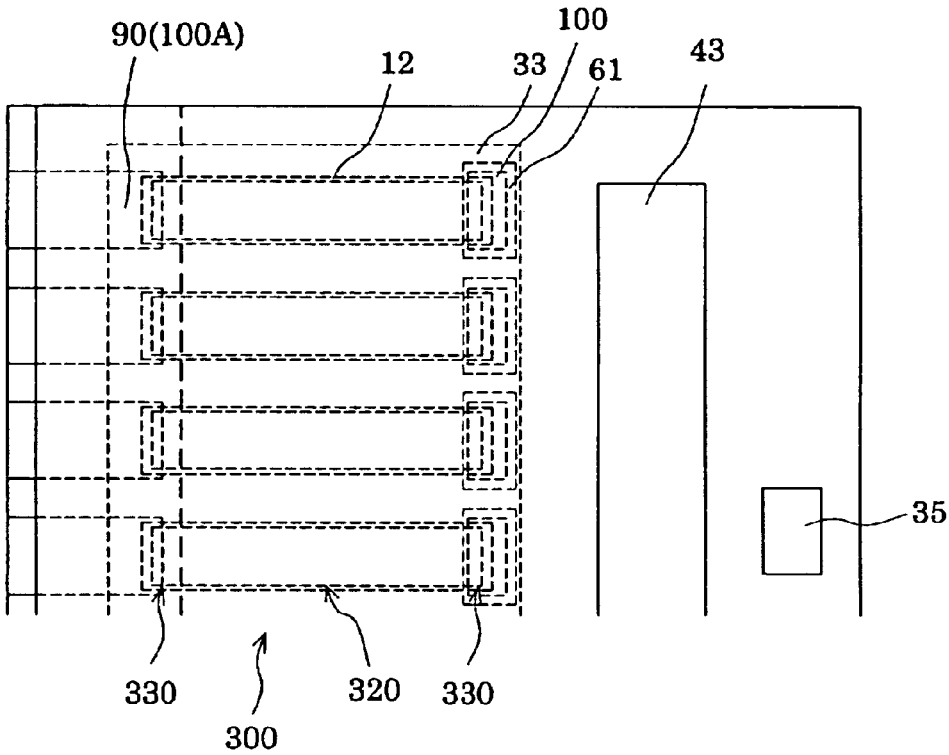
FIG. 2A is a plan view showing the ink-jet recording head according to the first embodiment of the present invention.
Figure 2B:
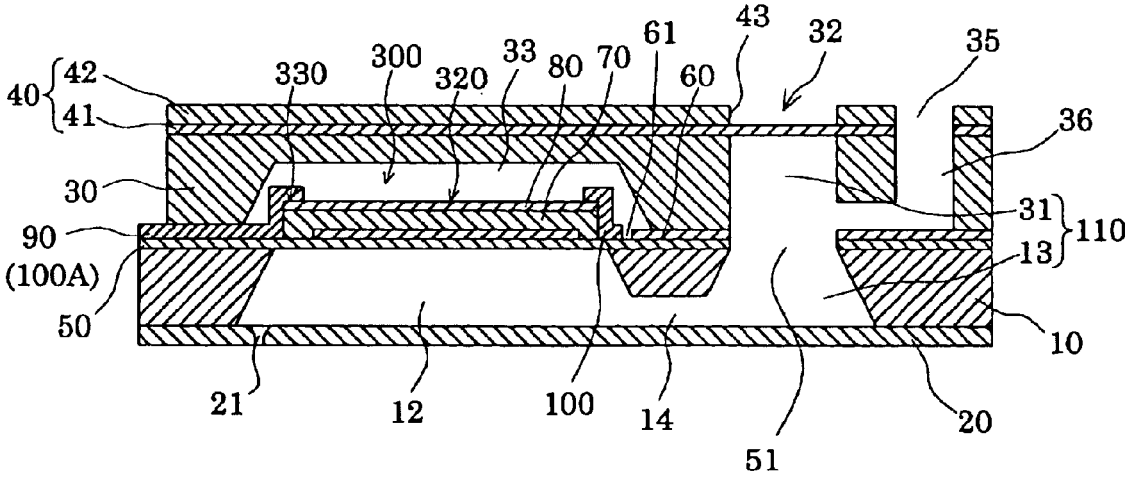
FIG. 2B is a section view of the ink-jet recording head according to the first embodiment of the present invention.

FIG. 1 is an exploded perspective view showing an ink-jet recording head according to a first embodiment of the present invention. FIG. 2A is a plan view of FIG. 1, and FIG. 2B is a section view of FIG. 1.

As illustrated in the drawings, a passage-forming substrate 10 is formed of a silicon single crystal substrate having a plane (110) of the plane orientation in this embodiment. One surface of the passage-forming substrate 10 is an opening surface, and an elastic film 50 having a thickness of 1 to 2 $\mu$m, which is made of silicon dioxide and formed by a thermal oxidation, is previously formed on the other surface thereof.

In the passage-forming substrate 10, pressure generating chambers 12 compartmented by a plurality of compartment walls 11 are provided in its width direction. The pressure generating chambers 12 are formed by anisotropically etching the silicon single crystal substrate. A communicating portion 13 is formed on an outer side in a longitudinal direction of the passage-forming substrate 10. The communicating portion 13 constitutes constitute a part of a reservoir 110 that communicates with a reservoir portion of a reservoir-forming substrate to be described later and becomes a common ink chamber of the respective pressure generating chambers 12. The communicating portion 13 communicates with an end portion of each of the pressure generating chambers 12 in its longitudinal direction via an ink supply path 14.

Herein, the anisotropic etching is carried out by utilizing a difference of an etching rate in the silicon single crystal substrate. For example, in this embodiment, the anisotropic etching is carried out by utilizing the following nature of the silicon single crystal substrate. Specifically, when the silicon single crystal substrate is dipped in alkali solution such as a KOH solution, the silicon single crystal substrate is slowly corroded, and a first (111) plane perpendicular to a (110) plane and a second (111) plane which forms an angle of about 70° relative to the first (111) plane and an angle of about 35° relative to the (110) plane appear. An etching rate of the (111) plane is about 1/180 of that of the (110) plane. By such an isotropic etching, precision processing can be performed based on depth processing for a parallelogram formed of the two first (111) planes and the two oblique second (111) planes, thus enabling the pressure generating chambers 12 to be arranged in high density.

In this embodiment, a long side of each of the pressure generating chambers 12 is formed by the first (111) plane, and a short side thereof is formed by the second (111) plane. Each of the pressure generating chambers 12 is formed by etching the passage-forming substrate 10 until the pressure generating chamber 12 penetrates almost through the passage-forming substrate 10 to reach the elastic film 50. Herein, the elastic film 50 shows a very small amount of etching by alkali solution which etches the silicon single crystal substrate. Each ink supply path 14 communicating with one end of the corresponding pressure generating chamber 12 is formed to be shallower than the pressure generating chamber 12, and keeps flow resistance of ink constant, which flows into the pressure generating chamber 12. Specifically, the ink supply path 14 is formed by etching (half-etching) a part of the silicon single crystal substrate in its thickness direction from its surface. Note that, the half-etching is performed by adjusting an etching time.

A thickness of such a passage-forming substrate 10 is selectively determined to an optimum value in conformity with a density of the arrangement of the pressure generating chambers 12. For example, in the case where the pressure generating chambers 12 are arranged so as to obtain a resolution of 180 dpi, the thickness of the passage-forming substrate 10 should be preferably set to a range of about 180 to 280 $\mu$m, more preferably to about 220 $\mu$m. Furthermore, in the case where the pressure generating chambers 12 are arranged so as to obtain a resolution of 360 dpi, the thickness of the passage-forming substrate 10 should be preferably set to be 100 $\mu$m or less. This is because the arrangement density of the pressure generating chambers 12 can be increased while keeping rigidity of the compartment wall between the pressure generating chambers adjacent to each other.

Furthermore, a nozzle plate 20 having nozzle orifices 21 bored therein is fixed to the other surface of the passage-forming substrate 10 with adhesive, a thermal adhesion film or the like interposed therebetween. The nozzle orifice 21 communicates with each pressure generating chamber 12 on the opposite side to the ink supply path 14. Note that, the nozzle plate 20 is made of, for example, glass ceramics, stainless steel or the like, which has a thickness ranging from 0.1 to 1 mm and a linear expansivity ranging from 2.5 to 4.5 [$\times 10^{-6}$/° C.] at a temperature of 300° C. or less. The nozzle plate 20 covers one plane of the passage-forming substrate 10 entirely with its one plane, and serves also as a reinforcement plate for protecting the silicon single crystal substrate from shock or external force. Furthermore, the nozzle plate 20 may be formed by a material having approximately the same linear expansivity as that of the passage-forming substrate 10. In this case, since deformations of the passage-forming substrate 10 and the nozzle plate 20 by heat are approximately equal to each other, both can be easily adhered to each other by use of thermosetting adhesive or the like.

Herein, a size of the pressure generating chamber 12 giving ink droplet ejection pressure to ink and a size of the nozzle orifice 21 ejecting the ink droplets are optimized in accordance with an amount of the ejected ink droplets, an ejection speed of the ink droplets and an ejection frequency. For example, when 360 ink droplets per one inch are recorded, the nozzle orifice 21 must be formed with high precision so that its diameter is several ten $\mu$m.

On the other hand, on the elastic film 50 formed on the passage-forming substrate 10, a lower electrode film 60 having a thickness of, for example, about 0.2 $\mu$m, a piezoelectric layer 70 having a thickness ranging, for example, from about 0.5 to 3 $\mu$m and an upper electrode film 80 having a thickness of, for example, about 0.1 $\mu$m are lamenated by a process to be described later. A piezoelectric element 300 is constituted. Herein, in principle the piezoelectric element 300 means a portion including the lower electrode film 60, the piezoelectric layer 70 and the upper electrode film 80. Generally, any one of electrodes of the piezoelectric element 300 is used as a common electrode, and the other electrode and the piezoelectric layer 70 are constituted by patterning for each pressure generating chamber 12. Herein, a portion which is constituted by any one of the electrodes and the piezoelectric layer patterned and causes piezoelectric strain by application of a voltage to both electrodes is called a piezoelectric active portion 320. In this embodiment, the lower electrode film 60 is used as the common electrode of the piezoelectric element 300, and the upper electrode film 80 is used as an individual electrode of the piezoelectric element 300. However, for convenience for a driving circuit and a wiring, the lower electrode film 60 may be used as the individual electrode, and the upper electrode film 80 may be used as the common electrode. In any case, the piezoelectric active portion will be formed for each pressure generating chamber. Moreover, herein, the piezoelectric element 300 and a vibration plate causing displacement by driving the piezoelectric element 300 are called a piezoelectric actuator in combination with each other.

Herein, a structure of such a piezoelectric element 300 will be described in detail.

As shown in FIG. 2A and 2B, the lower electrode film 60 constituting a part of the piezoelectric element 300 is continuously provided in a region facing each of the plurality of pressure generating chambers 12 parellelly provided. The lower electrode film 60 is removed over a width direction of the pressure generating chamber 12 in the vicinity of one end of the pressure generating chamber 12 in its longitudinal direction. The lower electrode film 60 in the vicinity of the other end of the pressure generating chamber 12 in its longitudinal direction is patterned for each pressure-generating chamber 12, and, a lower-electrode film-removal portion 61 having, for example, an approximately rectangular shape is formed. The elastic film 50 positioned at a region facing a edge portion of the pressure generating chamber 12 in its longitudinal direction is exposed. In this embodiment, by patterning the lower electrode film 60 as described above, the piezoelectric active portion 320 serving as a substantial drive portion of the piezoelectric element 300 and a piezoelectric non-active portion 330 are formed. The piezoelectric non-active portion 330 is provided in both ends of the piezoelectric active portion 320 in its longitudinal direction, and is not driven though the non-active portion 330 has the piezoelectric layer 70 continuous to the piezoelectric active portion 320.

Furthermore, in this embodiment, the piezoelectric layer 70 and the upper electrode film 80 are patterned in a region facing the pressure generating chamber 12, and the piezoelectric element 300 is provided independently in a region facing each pressure generating chamber 12. The upper electrode film 80 is connected to an external wiring (not shown) via a lead electrode 90 that is a wiring electrode provided on the elastic film 50 so as to extend from one end of the piezoelectric element 300 in its longitudinal direction.

Note that, in this embodiment, since the lower electrode film 60 constituting the piezoelectric element 300 is patterned to a predetermined shape as described above, the elastic film 50 serves as a substantial vibration plate.

A protection layer 100 is provided at least in the other end of the pressure generating chamber 12 in its longitudinal direction, specifically, in one end of the pressure generating chamber 12 opposite to the extended lead electrode 90. The protection layer 100 protects the vibration plate (elastic film 50) in a region facing an end of the pressure generating chamber 12 and the vibration plate (elastic film 50) in a region facing an end of the piezoelectric layer 70 in a region facing the pressure generating chamber 12.

For example, in this embodiment, an electrode constituent layer 91, which is made of the same layer as the lead electrode 90 and provided independently from the lead electrode 90, is provided so as to cover the elastic film 50 positioned at the region facing the end of the piezoelectric non-active portion 330 and at the region facing the end of the pressure generating chamber 12 in its longitudinal direction.

Accordingly, the electrode constituent layer 91 is the protection layer 100.

Herein, as described above, in the other end of the pressure generating chamber 12 in its longitudinal direction, the lower-electrode film-removal portion 61 is formed by removing the lower electrode film 60 for each pressure generating chamber 12, and the elastic film 50 is exposed. The protection layer 100 is patterned in the lower-electrode film-removal portion 61, and formed so as not to contact the lower electrode film 60.

Furthermore, this protection layer 100 should be preferably provided so as to cover a region facing a corner portion of the other end of the pressure generating chamber 12 in its longitudinal direction, and, in this embodiment, formed so as to have a width wider than that of the pressure generating chamber 12.

Although a thickness of the protection layer 100 is not particularly limited, the thickness of the protection layer 100 should be preferably set to a value so that rigidity of the protection layer 100 is higher than that of the lower electrode film 60, and, in this embodiment, the protection layer 100 is formed so that the protection layer 100 has a thicker thickness than the lower electrode film 60.

In this embodiment, also a vibration plate in a region facing one end of the pressure generating chamber 12 in its longitudinal direction is covered by the protection layer 100A. Specifically, the lead electrode 90 is provided so as to extend outside a boundary between the piezoelectric active portion 320 and the piezoelectric non-active portion 330 and so as to have a width wider than the pressure generating chamber 12. The elastic film 50 in the region facing the vicinity of one end of the piezoelectric element 300 in its longitudinal direction and the fringe of the pressure generating chamber 12 is covered by the lead electrode 90, and, in this embodiment, the lead electrode 90 serves also as the protection layer 100A.

As described above, since the ink-jet recording head of this embodiment is designed so that the vibration plate in the region facing the end of the pressure generating chamber 12 in its longitudinal direction is covered by the protection layers 100 and 100A, the rigidity of the vibration plate is increased, and it is possible to prevent occurrence of cracks and the like in the vibration plate due to the repeated deformations by the drive of the piezoelectric element 300.

Furthermore, since the vibration plate in the region facing the end of the piezoelectric element 300 in its longitudinal direction is covered by the protection layers 100 and 100A, the rigidity of the vibration plate in the vicinity of the end of the piezoelectric element 300 in its longitudinal direction is increased, and hence stress applied to the vicinity of the end of the piezoelectric element 300 in its longitudinal direction in driving the piezoelectric element 300 can be suppressed. Therefore, when the piezoelectric element 300 is driven, an amount of displacement in the end of the piezoelectric element 300 in its longitudinal direction is reduced, so that it is possible to prevent the piezoelectric layer 70 from being damaged by the repeated deformations by the drive of the piezoelectric element 300.

Since the protection layer 100 is formed by the electrode constituent layer 91 made of the same layer as the lead layer 90, it is unnecessary to increase the number of the manufacturing steps, and the protection layer 100 can be formed without increasing manufacturing cost.

Furthermore, in this embodiment, the lower electrode film 60 on the other end side of the pressure generating chamber 12 in its longitudinal direction is removed for each pressure generating chamber 12 to form the lower-electrode film-removal portion 61, and hence a removal area of the lower electrode film 60 is made to be comparatively small. Therefore, a resistivity of the lower electrode film 60 is never increased. Accordingly, a voltage can be applied to the piezoelectric layer 70 constituting the piezoelectric element 300 in a good state. Note that, if the resistivity of the lower electrode film 60 is not increased, it is natural that the lower-electrode film-removal portion 61 may be provided continuously over regions facing the plurality of pressure generating chambers 12.

A process for forming the piezoelectric element 300 and the like on the passage-forming substrate 10 made of the silicon single crystal substrate will be described with reference to FIGS. 3A to 3D and FIGS. 4A to 4C. Note that, FIGS. 3A to 3D and FIGS. 4A to 4C are section views of the pressure generating chamber 12 in its longitudinal direction.

Figure 3A:
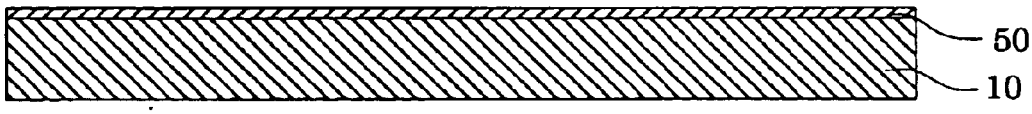
FIGS. 3A to 3D are section views showing thin-film manufacturing processes of manufacturing the ink-jet recording head according to the first embodiment of the present invention.

First, as shown in FIG. 3A, a wafer of the silicon single crystal substrate used for the passage-forming substrate 10 is thermally oxidized in a diffusion furnace at a temperature of about 1100° C., and thus the elastic film 50 made of silicon dioxide is formed.

Figure 3B:
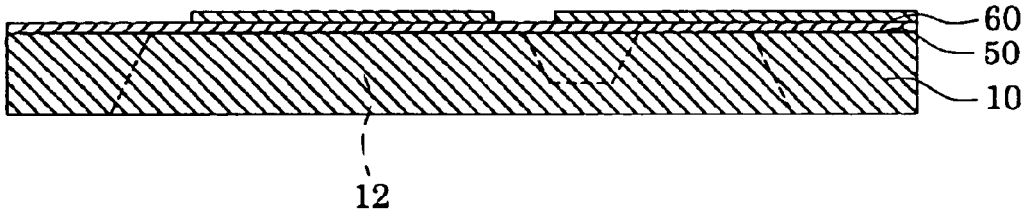

Next, as shown in FIG. 3B, the lower electrode film 60 is formed on the entire surface of the elastic film 50 by sputtering, and thereafter the lower electrode film 60 is patterned, thus forming an entire pattern. Specifically, in a region on one end side of the pressure generating chamber 12 in its longitudinal direction, the lower electrode film 60 is removed over a width direction of the pressure generating chamber 12. In a region on the other end side of the pressure generating chamber 12 in its longitudinal direction, the lower-electrode film-removal portion 61 which is independent for each pressure generating chamber 12 is formed. As a material of the lower electrode film 60, platinum and the like are preferable. This is because the piezoelectric layer 70 to be described later, which is formed by a sputtering method and a sol-gel method, must be crystallized by sintering it at a temperature of about 600 to 1000° C. at atmosphere of the air or oxygen after the formation thereof. Specifically, the material of the lower electrode film 60 needs to keep conductivity at such a high temperature and at such an oxidation atmosphere. When lead zirconate titanate (PZT) is used as the piezoelectric layer 70, a change of the conductivity due to diffusion of lead oxide should be small, and platinum is preferable because of these reasons.

Figure 3C:
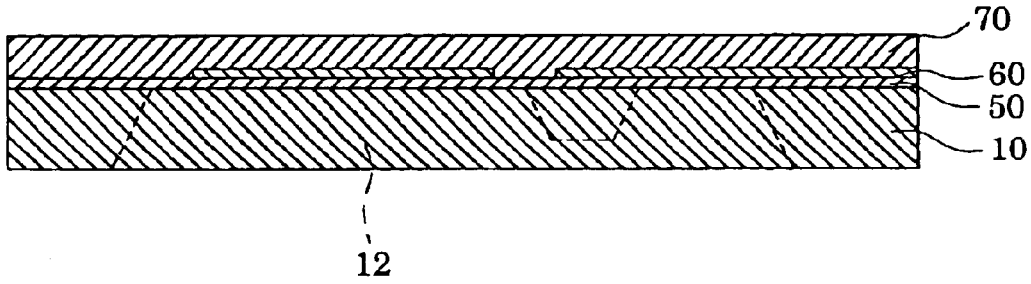

Next, as shown in FIG. 3C, the piezoelectric layer 70 is formed. In this piezoelectric film 70, the crystal should be oriented. For example, in this embodiment, the piezoelectric layer 70 is formed by a sol-gel method in which sol obtained by dissolving organic metal in catalyst to disperse it therein is gelled by coating and drying, and sintering at a high temperature, thus obtaining the piezoelectric layer 70 made of metal oxide in which the crystal is oriented. As a material of the piezoelectric layer 70, the one of lead zirconate titanate series is preferable when it is used in an ink-jet recording head. Note that, a method for forming the piezoelectric layer 70 is not particularly limited and the piezoelectric layer 70 may be formed, for example, by a sputtering method.

Furthermore, after a precursor film of lead zirconate titanate is formed by the sol-gel method or the sputtering method, a method may be used for forming the piezoelectric layer 70, in which a crystal growth is performed at a low temperature by use of a high pressure treatment technique in an alkali aqueous solution.

At any rate, in the piezoelectric layer 70 formed in such a manner, the crystals show preferential orientation unlike a bulk piezoelectric. Moreover, in this embodiment, in the piezoelectric layer 70, the crystals are formed in a columnar shape. Note that, the preferential orientation means a state where an orientation direction of the crystals is not disordered, but specific crystal planes are directed to an approximately certain direction. A thin film of which the crystals are columnar means a state where approximately cylindrical crystals form a thin film as they are aggregated along a planar direction in a state that central axes of the crystals are nearly aligned with a thickness direction. Of course, the thin film may be one formed with preferentially oriented granular crystals. It should be noted that a thickness of the piezoelectric layer thus manufactured by the thin-film process is generally 0.2 to 5 $\mu$m.

Figure 3D:
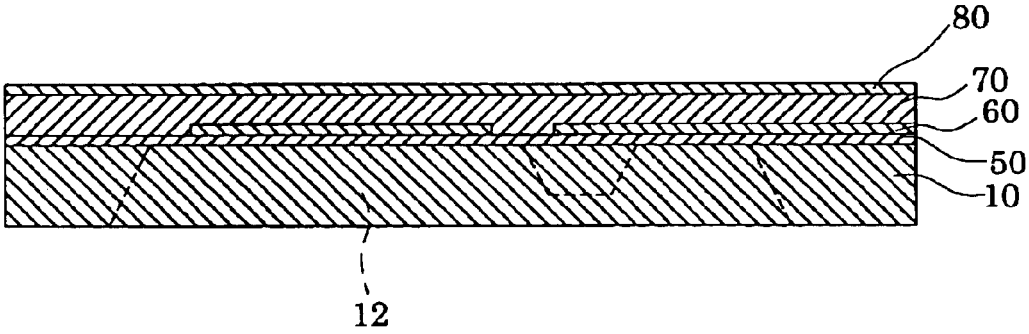

Next, as shown in FIG. 3D, the upper electrode film 80 is formed. The upper electrode film 80 may be made of a material having high conductivity; therefore, various metal materials such as aluminum, gold, nickel and platinum or conductive oxide materials can be used. In this embodiment, platinum is formed by sputtering.

Figure 4A:
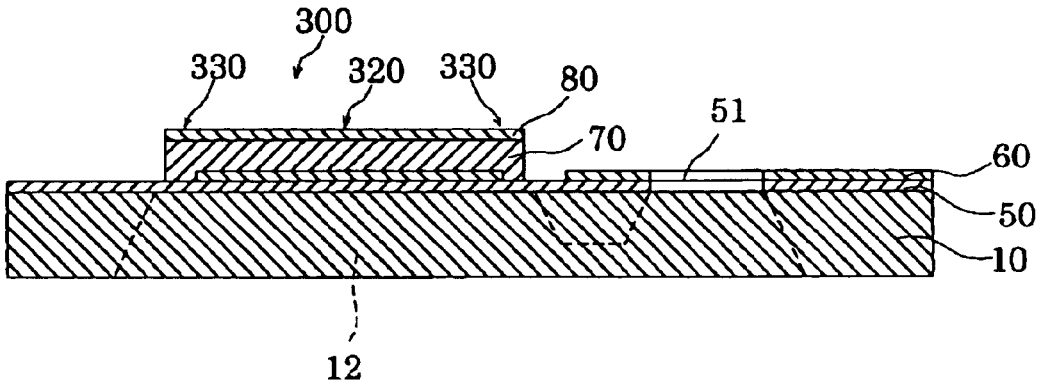
FIGS. 4A to 4C are section views showing thin-film manufacturing processes of manufacturing the ink-jet recording head according to the first embodiment of the present invention.

Next, as shown in FIG. 4A, patterning of the piezoelectric active portion 320 and the piezoelectric non-active portion 330 is carried out by etching only the piezoelectric layer 70 and the upper electrode film 80. In other words, the piezoelectric element 300 composed of the region facing the pressure generating chamber 12 where the lower electrode film 60 is formed becomes the piezoelectric active portion 320, and the region where the lower electrode film 60 is removed becomes the piezoelectric non-active portion 330.

Figure 4B:
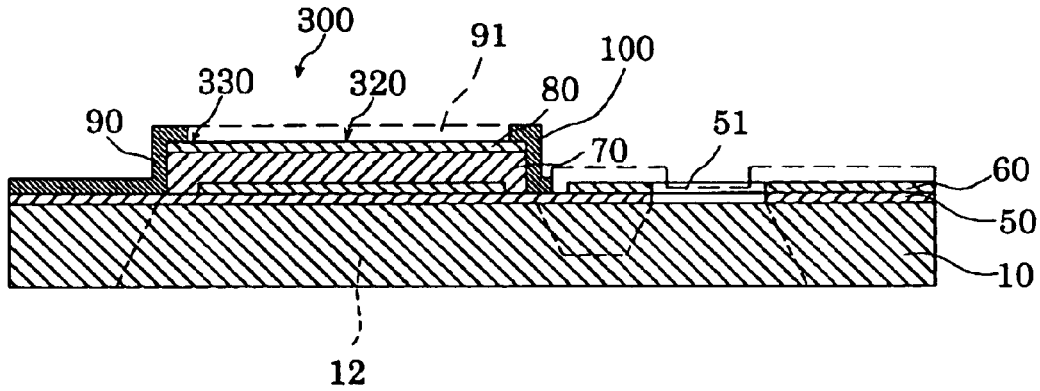

Next, as shown in FIG. 4B, the lead electrode 90 (the protection layer 100A) and the protection layer 100 are formed. In particular, the lead electrode 90 for connecting the upper electrode film 80 with the external wiring is formed on one end portion of the piezoelectric element 300 in its longitudinal direction by forming the electrode constituent layer 91 of gold (Au) or the like, for example, over an entire surface of the passage-forming substrate 10 and by patterning each piezoelectric element 300, and the protection layer 100 is formed on the other end portion. Note that, the lead electrode 90 and the protection layer 100 may be provided with an adhesion layer made of nickel (Ni) , titanium (Ti), copper (Cu) or the like between the lead electrode 90 or the protection layer 100, and the passage-forming substrate 10.

Figure 4C:
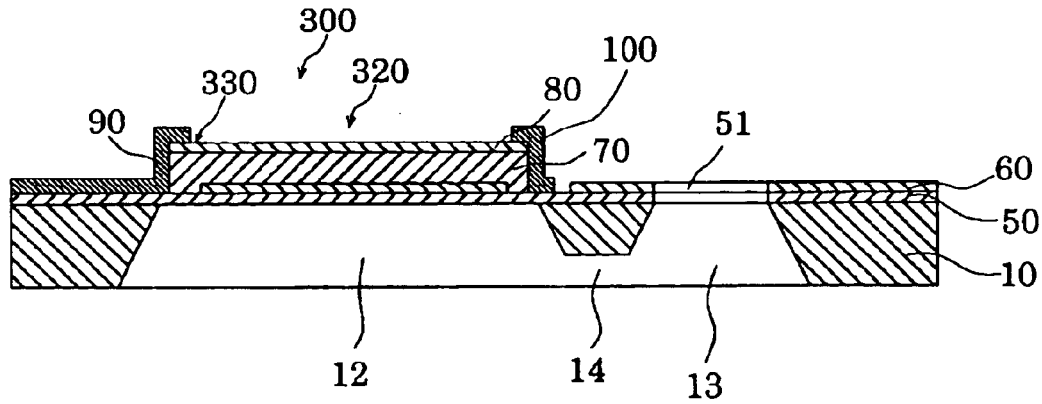

The foregoing is the film-forming process. After the film-forming is performed in this way, the aforementioned anisotropic etching of the silicon single crystal substrate using an alkali solution is performed, thus forming the pressure generating chamber 12, the communicating portion 13 and the ink supply path 14 and the like, as shown in FIG. 4C.

In fact, numerous chips are formed on one wafer simultaneously by the series of film-forming and anisotropic etching, and when the process is completed, the wafer is divided into the passage-forming substrate s 10 each having one chip size as shown in FIG. 1. Thereafter, a reservoir-forming substrate 30 and a compliance substrate 40 as described later are serially adhered to the divided passage-forming substrate 10 and integrated, thus forming the ink-jet recording head.

In other words, as shown in FIG. 1 and FIG. 2, the reservoir-forming substrate 30 having a reservoir portion 31 that constitutes at least a part of a reservoir 110 is joined to the side of the piezoelectric element 300 of the passage-forming substrate 10 where the pressure generating chamber 12 and the like are formed. The reservoir portion 31 in this embodiment is formed along a width direction of the pressure generating chamber 12 while penetrating the reservoir-forming substrate 30 in a thickness direction thereof. And, the reservoir portion 31 is communicated with the communicating portion 13 of the passage-forming substrate 10 via a through hole 51 provided as penetrating the elastic film 50 and the lower electrode film 60, thus constituting the reservoir 110 as a common ink chamber to the pressure generating chambers 12.

As for the reservoir-forming substrate 30, it is preferable to use a material such as glass, a ceramic material or the like, for example, which has a thermal expansion rate approximately equal to that of the passage-forming substrate 10. In this embodiment, the reservoir-forming substrate 30 is formed by use of a silicon single crystal substrate, which is the same material as the passage-forming substrate 10. In this way, similarly to the above-described case of the nozzle plate 20, both members are securely adhered together even in the case of high-temperature adhesion using thermosetting adhesive. Accordingly, a manufacturing process can be simplified.

In addition, the compliance plate 40 composed of a sealing film 41 and a fixing plate 42 is joined to the reservoir-forming substrate 30. Here, the sealing film 41 is made of a material having low rigidity and high flexibility (for example, a polyphenylene sulfide (PPS) film having a thickness of 6 $\mu$m) and one face of the reservoir portion 31 is sealed with the sealing film 41. The fixing plate 42 is formed of a hard material such as metal (for example, a stainless steel (SUS) having a thickness of 30 $\mu$m or the like). Since a region of the fixing plate 42 facing the reservoir 110 is an aperture 43 completely removed in a thickness direction, one face of the reservoir 110 is sealed only by the sealing film 41 having flexibility, thus forming a flexible portion 32 deformable by variations of internal pressure in reservoir 110.

Moreover, an ink introduce port 35 for supplying ink to the reservoir 110 is formed on the compliance substrate 40, on an outer side of an approximately central portion of the reservoir 110 in its longitudinal direction. In addition, an ink introduce path 36 for communicating the ink introduce port 35 with a sidewall of the reservoir 110 is provided on the reservoir-forming substrate 30.

On the other hand in, a region of the reservoir-forming substrate 30 facing the piezoelectric element 300, a piezoelectric element holder portion 33 is provided in a state of securing a space to the extent not inhibiting motion of the piezoelectric element 300 in such a manner that the space can be thereby sealed. And, at least the piezoelectric active portion 320 of the piezoelectric element 300 is sealed within the piezoelectric element holder portion 33, thus preventing the piezoelectric element 300 from damage caused by the external environment such as humidity of the atmosphere.

The ink-jet recording head thus composed takes in ink from the ink introduce port 35 connected with unillustrated external ink supply means and fills the inside from the common ink chamber 31 to the nozzle orifice 21 with the ink. Thereafter, voltage is applied between the upper electrode film 80 and the lower electrode film 60 in accordance with record signals from an unillustrated external drive circuit, and the elastic film 50, the lower electrode film 60 and the piezoelectric layer 70 are subjected to flexural deformation. Pressure inside the pressure generating chamber 12 is thereby increased, and ink droplets are ejected from the nozzle orifice 21.

(Embodiment 2)

Figure 5A:
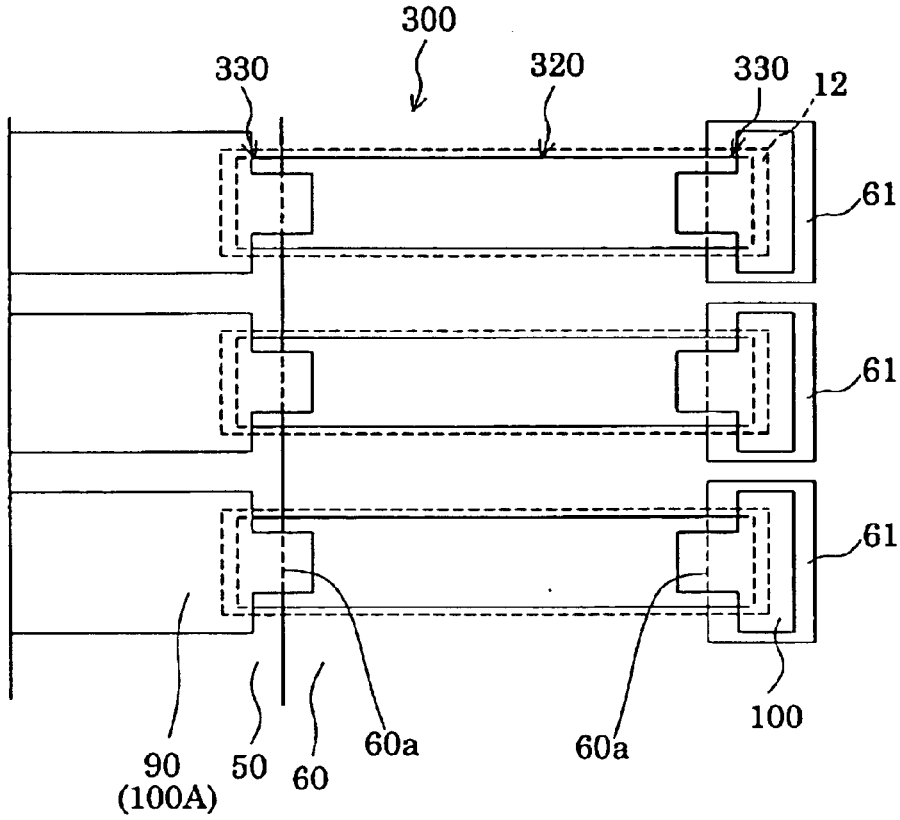
FIG. 5A is a plan view showing a principal part of an ink-jet recording head according to a second embodiment of the present invention.
Figure 5B:
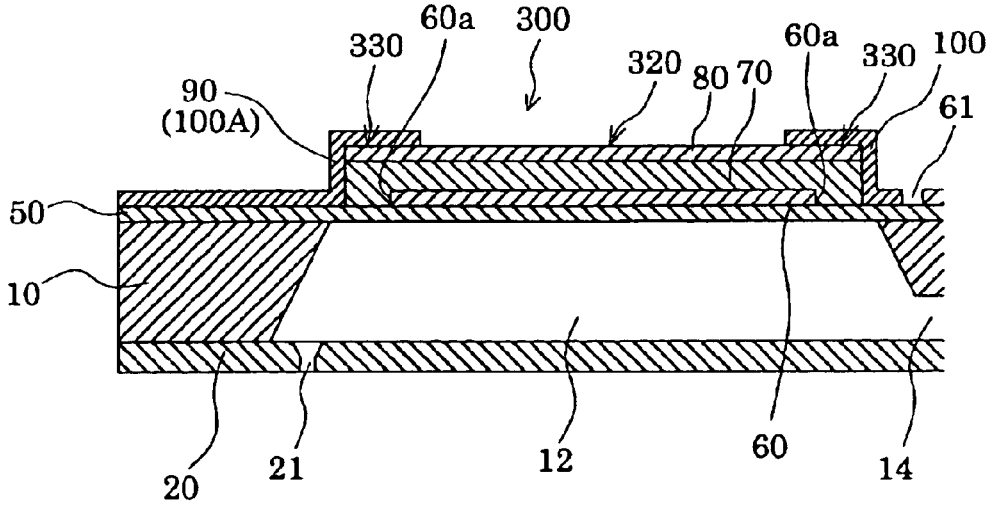
FIG. 5B is a section view of the principal part of the ink-jet recording head according to the second embodiment of the present invention.

FIGS. 5A and 5B are a plan view and a cross-sectional view showing a principal part of an ink-jet recording head according to embodiment 2.

As shown in FIGS. 5A and 5B, this embodiment is similar to the first embodiment except that an end portion 60*a* of the patterned lower electrode film 60 functions as an end portion of the piezoelectric active portion 320, and that the protection layer 100 and the lead electrode 90 being a protection layer 100A are provided as they extend beyond a boundary between the piezoelectric active portion 320 and the piezoelectric non-active portion 330.

In this way, steep stress variation at the boundary between the piezoelectric active portion 320 and the piezoelectric non-active portion 330 can be prevented, whereby damage to the piezoelectric layer 70 associated with the stress variation can be effectively prevented. And also in such a constitution, similar effects to the embodiment 1 can be obtained as a matter of course.

Figure 6:
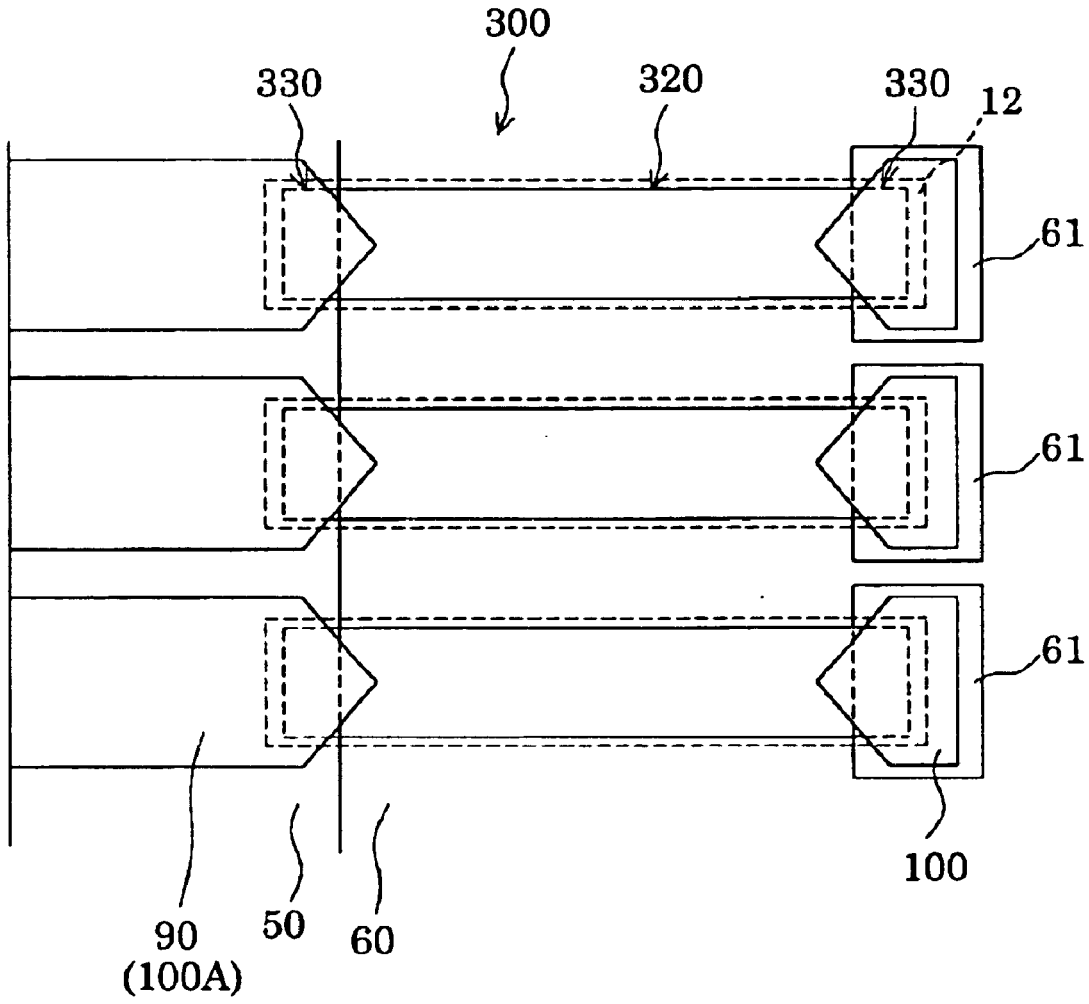
FIG. 6 is a plan view showing a modification of the ink-jet recording head according to the second embodiment of the present invention.

Note that, in this embodiment, the protection layers 100 and 100A in the regions facing the piezoelectric active portion 320 are formed in a width narrower than the piezoelectric element 300, and they are formed in a width wider than the pressure generating chamber 12 in the regions outside the boundary between the piezoelectric active portion 320 and the piezoelectric non-active portion 330. However, shapes of the protection layers 100 and 100A are not particularly limited. For example, as shown in FIG. 6, the protection layers 100 and 100A may be formed in a manner that the width in the vicinity of end portions of the side of the piezoelectric active portion 320 are made to gradually decrease toward tip portions thereof, and that the widths thereof are formed wider than the pressure generating chamber 12 in the regions outside the boundary between the piezoelectric active portion 320 and the piezoelectric non-active portion 330.

(Embodiment 3)

Figure 7A:
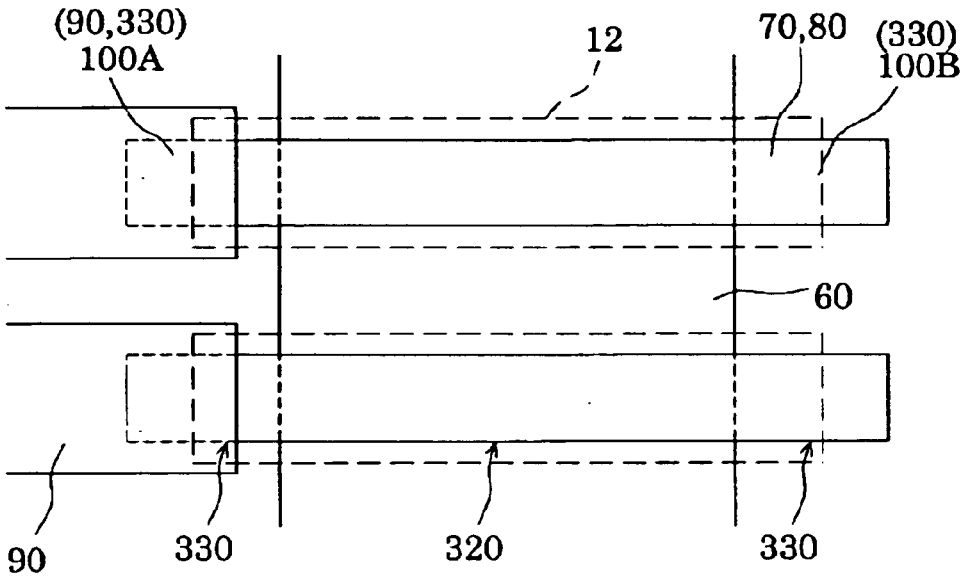
FIG. 7A is a plan view showing an principal part of an ink-jet recording head according to a third embodiment of the present invention.
Figure 7B:
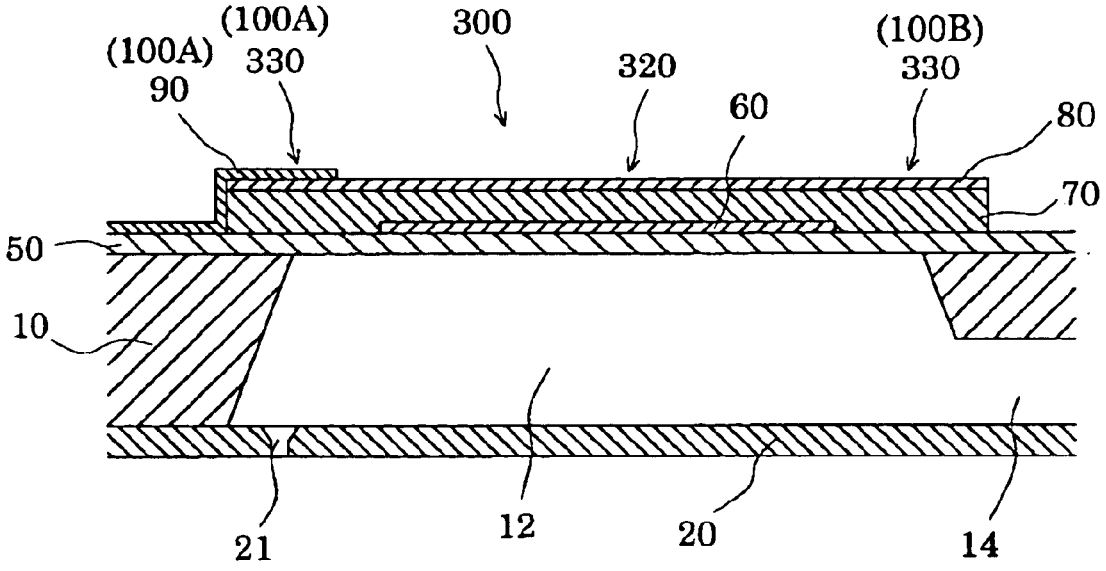
FIG. 7B is a section view of the principal part of the ink-jet recording head according to the third embodiment of the present invention.

FIGS. 7A and 7B are a plan view and a cross-sectional view showing a principal part of an ink-jet recording head according to embodiment 3.

In this embodiment, as shown in FIGS. 7A and 7B, the lower electrode film 60 is patterned within the region facing the pressure generating chambers 12 in the vicinity of both end portions in its longitudinal direction, whereby the lower electrode film 60 is provided continuously to the regions facing a plurality of pressure generating chambers 12 arranged in parallel. And each of the piezoelectric non-active portions 330 at the both end portions in the longitudinal direction of the piezoelectric active portions 320 is provided as it extends over peripheral walls outside each of the both end portions in the longitudinal direction of the pressure generating chamber 12.

In other words, in this embodiment, the end portion of the piezoelectric layer 70 of the piezoelectric non-active portion 330 is located outside the region facing the pressure generating chamber 12, and a vibration plate in a region facing the end portion in the longitudinal direction of the pressure generating chamber 12 is covered with the piezoelectric non-active portion 330. And on the outgoing side of the lead electrode 90 of the pressure generating chamber 12, the lead electrode 90 and the piezoelectric non-active portion 330 constitute the protection layer 100A that protects the vibration plate in the region facing the end portion in the longitudinal direction of the pressure generating chamber 12. At the same time, on the other end portion of the pressure generating chamber 12, the region of the piezoelectric non-active portion 330 extended to the outside of the region facing the pressure generating chamber 12 constitutes the protection layer 100B.

It should be noted that, in this embodiment, the end portion of the piezoelectric layer 70 of the piezoelectric non-active portion 330 is located outside the region facing the pressure generating chamber 12. Accordingly, a protection layer is not provided on the piezoelectric non-active portion 330 in the region facing the end portion of the piezoelectric layer 70.

In such a constitution, rigidity of the vibration plate in the region facing the end portion in the longitudinal direction of the pressure generating chamber 12 is further enhanced owing to the protection layers 100A and 100B, each including the piezo electric non-active portion 330. Therefore, cracks of the vibration plate are not generated even by repetitive displacement due to drive of the piezoelectric element 300, and thus durability of the vibration plate is enhanced.

Moreover, since the rigidity of the vibration plate is enhanced, the vibration plate is not damaged even when the piezoelectric element 300 is driven by a relatively high voltage. Accordingly, the piezoelectric element 300 can be driven by the relatively high voltage for increasing an ink amount to be ejected, thus enhancing printing speed.

Figure 8A:
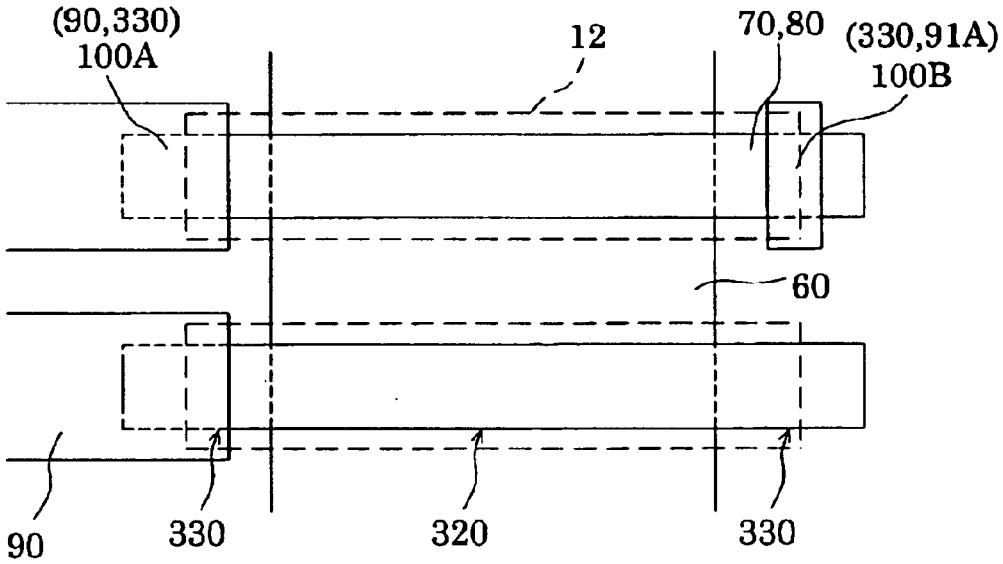
FIG. 8A is a plan view showing a modification of the ink-jet recording head according to the third embodiment of the present invention.
Figure 8B:
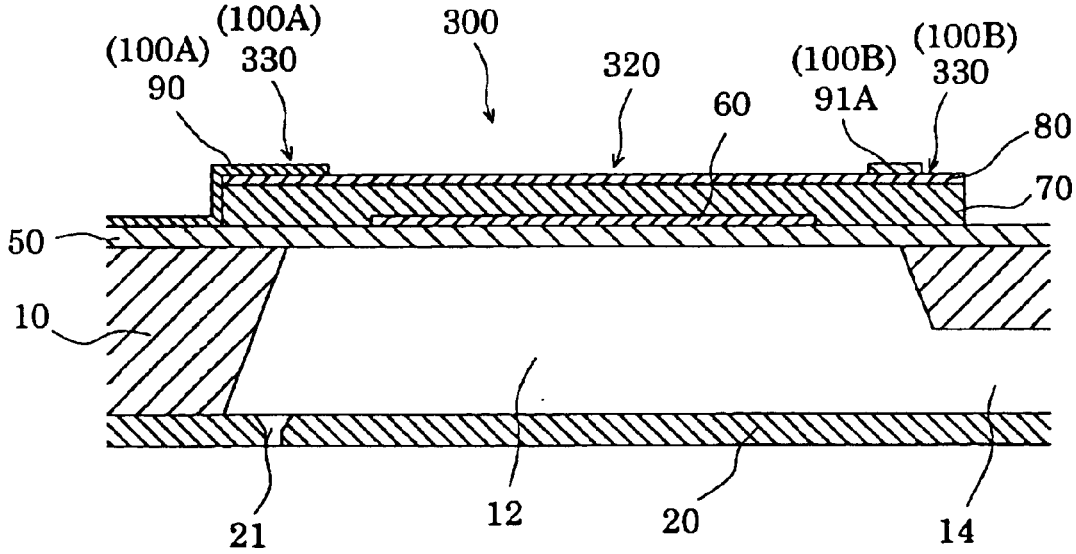
FIG. 8B is a section view of the modification of the ink-jet recording head according to the third embodiment of the present invention.

Note that, in this embodiment, the protection layer 100B consists only of the piezoelectric non-active portion 330. However, the protection layer 100B is not limited to the foregoing as a matter of course. As shown in FIG. 8, an electrode constituent layer 91A may be provided in the region facing the end portion in the longitudinal direction of the pressure generating chamber 12, and the protection layer 100B may be composed of the piezoelectric non-active portion 330 and the electrode constituent layer 91A.

(Embodiment 4)

Figure 9A:
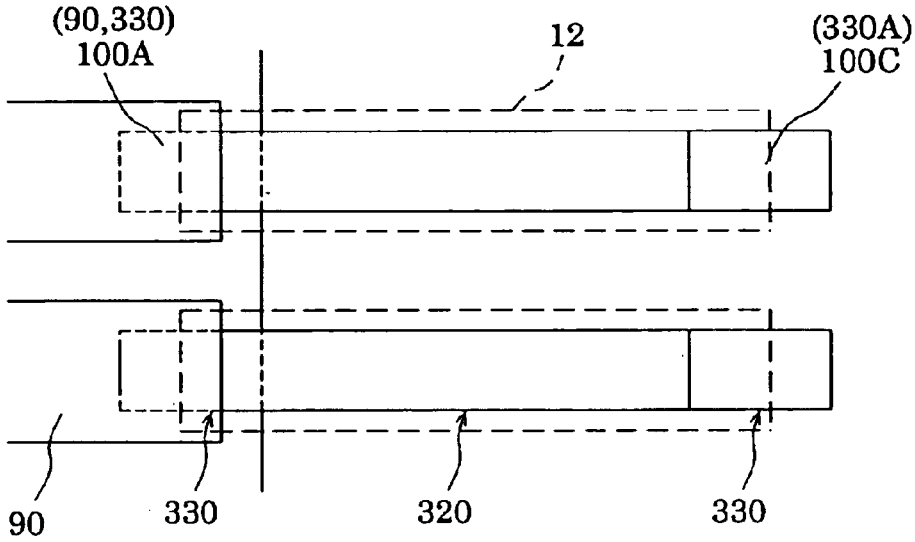
FIG. 9A is a plan view showing an principal part of an ink-jet recording head according to a fourth embodiment of the present invention.
Figure 9B:
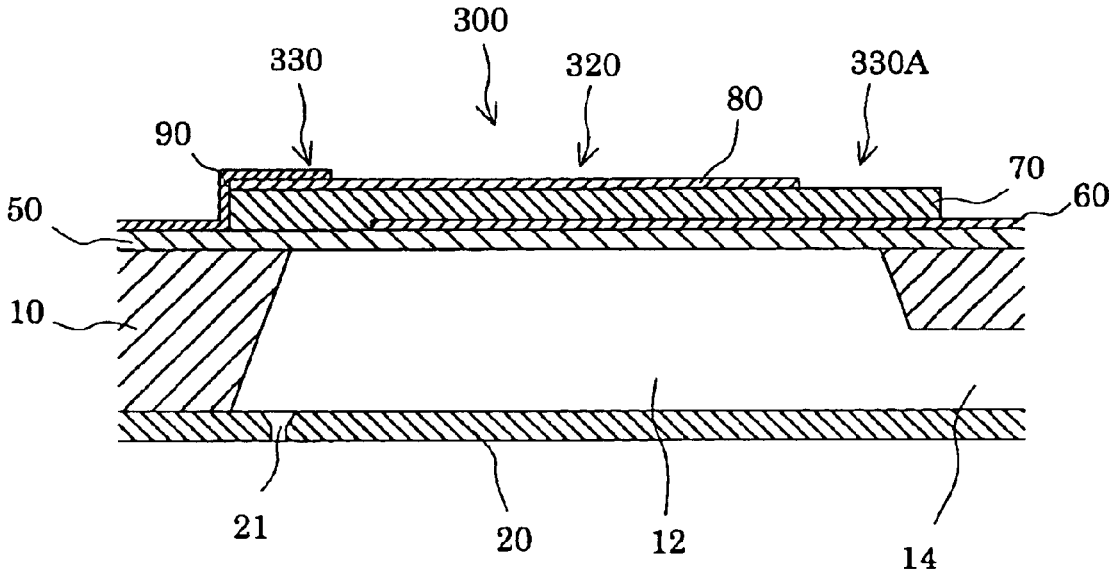
FIG. 9B is a section view of the principal part of the ink-jet recording head according to the fourth embodiment of the present invention.

FIGS. 9A and 9B are a plan view and a cross-sectional view showing a principal part of an ink-jet recording head according to embodiment 4.

As shown in FIGS. 9A and 9B, this embodiment is similar to the embodiment 3 except that a piezoelectric non-active portion 330A to be provided on the end portion opposite to the lead electrode 90 of the pressure generating chamber 12, that is, on the tip portion of the piezoelectric element 300, is formed by removing the upper electrode film 80.

In other words, in this embodiment, on the end portion opposite to the outgoing side of the lead electrode 90 of the pressure generating chamber 12, the lower electrode film 60 is continuously formed over a peripheral wall on the outside of the pressure generating chamber 12 without being patterned inside the pressure generating chamber 12. Moreover, the upper electrode film 80 is patterned in a region facing the pressure generating chamber 12, and an end portion of the upper electrode film 80 constitutes a boundary between the piezoelectric active portion 320 and the piezoelectric non-active portion 330A. In addition, this piezoelectric non-active portion 330A constitutes a protection layer 100C.

In this way, even when the piezoelectric non-active portion 330A is formed by removing the upper electrode film 80, occurrence of cracks on the vibration plate can be prevented in a similar manner to the embodiment 3.

(Embodiment 5)

Figure 10:
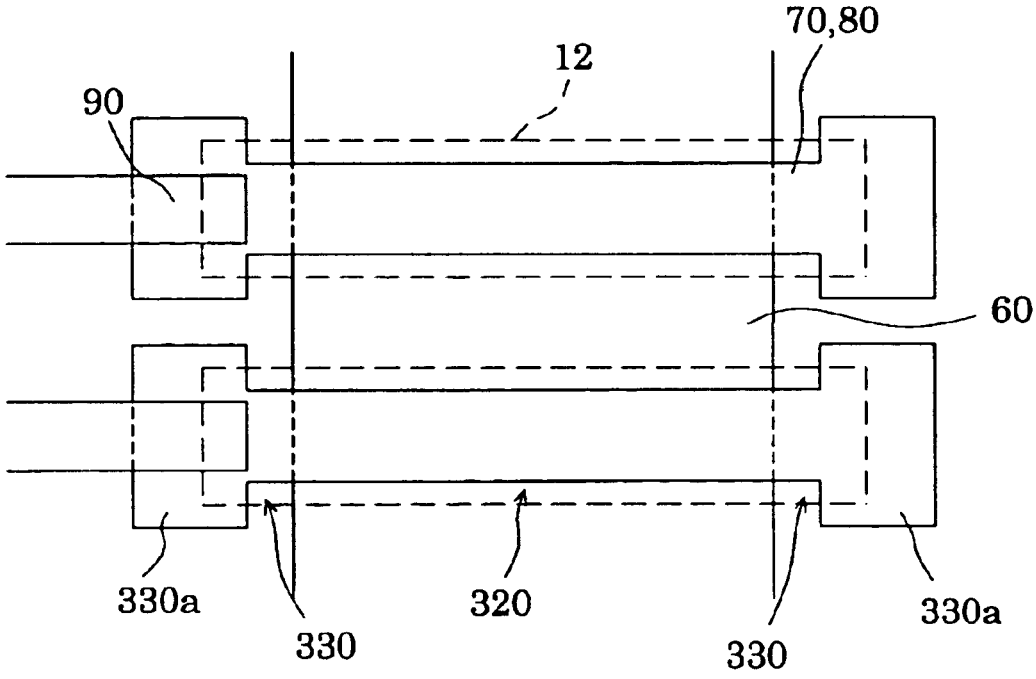
FIG. 10 is a plan view showing an principal part of an ink-jet recording head according a fifth embodiment of the present invention.

FIG. 10 is a plan view showing a principal part of an ink-jet recording head according to embodiment 5.

This embodiment is an example of covering the vibration plate in the region facing a corner portion of the pressure generating chamber 12 with the piezoelectric non-active portion 330 instead of the lead electrode 90 or the electrode constituent layer 91. In other words, as shown in FIG. 10, this embodiment is similar to the embodiment 4 except that broad portions 330*a* wider than the width of the pressure generating chamber 12 are provided in the regions facing the end portions in the longitudinal direction of the pressure generating chamber 12 of the piezoelectric non-active portions 330 being provided on both end portions of the piezoelectric active portion 320.

In such a constitution, the vibration plate in the vicinity of the end portions in the longitudinal direction of the pressure generating chamber 12 is completely covered with the piezoelectric non-active portions 330*a* that are the protection layers 100A and 100B. Therefore, the rigidity of the vibration plate is certainly enhanced, whereby occurrence of cracks on the vibration plate due to drive of the piezoelectric element 300 can be surely prevented.

Note that, in this embodiment, the piezoelectric non-active portion 330 is formed by removing the lower electrode film 60. However, the piezoelectric non-active portion 330 can be formed by removing the upper electrode film 80 as a matter of course.

(Other Embodiments)

Although various embodiments of the present invention have been described above, fundamental constitutions of ink-jet recording heads will not be limited to the foregoing.

For example, in the above-described embodiments, the piezoelectric non-active portion 330 is formed by removing either the lower electrode film 60 or the upper electrode film 80. However, without limitations to the foregoing, the piezoelectric non-active portion 330 may be formed by providing a low dielectric insulating layer between the piezoelectric layer 70 and the upper electrode film 80, for example. Moreover, it may also be formed by making the piezoelectric layer 70 partially inactive by means of doping and the like.

Moreover, the embodiments described above have taken a thin-film ink-jet recording head producible by application of film-forming and lithography processes as an example. However, the present invention is by no means limited to the foregoing, and for example, it can be adopted to ink-jet recording heads of various structures such as: one forming the pressure generating chamber by lamination of substrates; one forming the piezoelectric layer either by adhesion of a green sheet or by screen printing; and one forming the piezoelectric layer by hydrothermal crystal growth and the like.

As described above, the present invention can be adopted to ink-jet recording heads of various structures to the extent not departing from the spirit and scope thereof.

Figure 11:
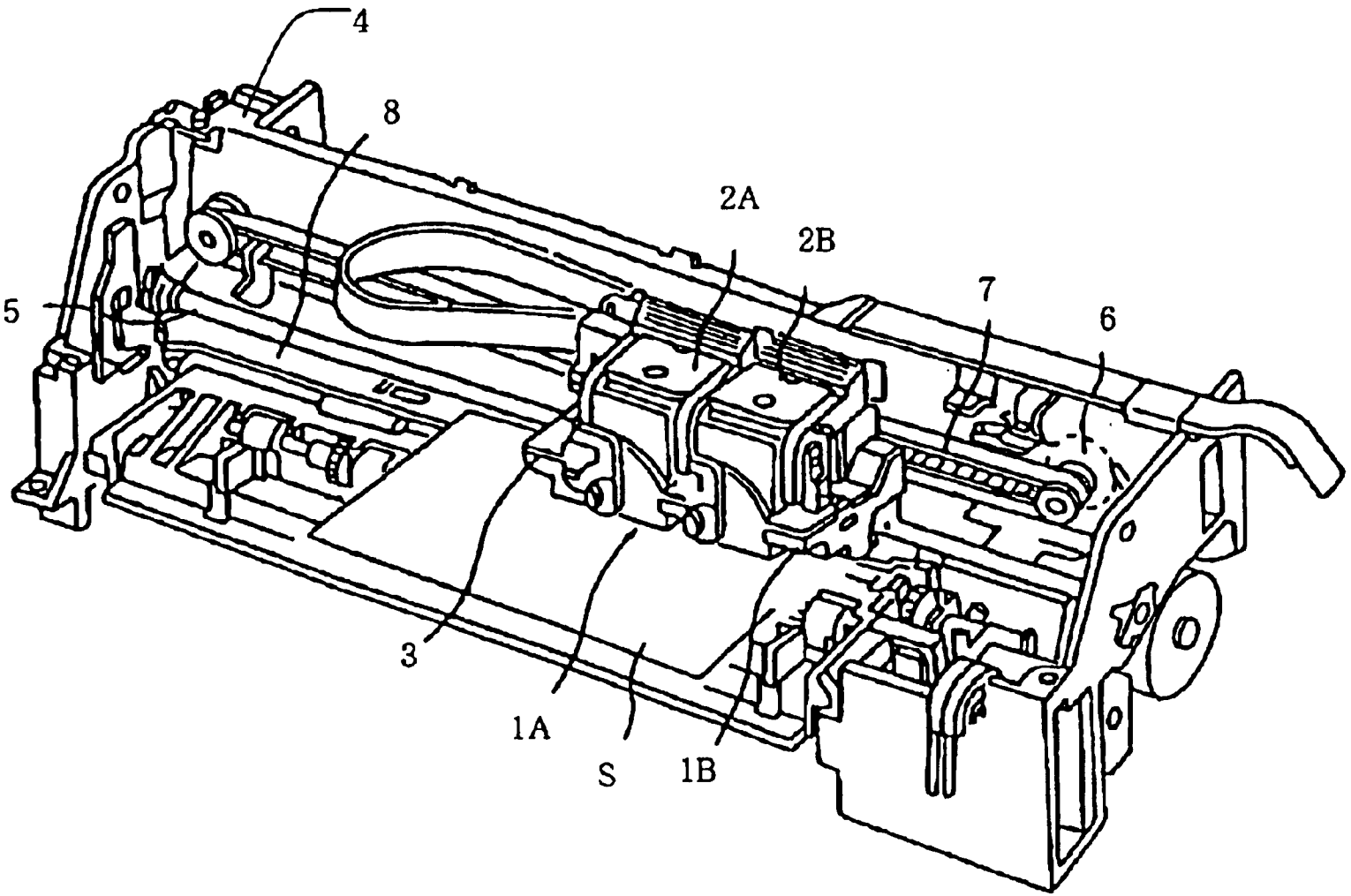
FIG. 11 is a schematic view showing an ink-jet recording apparatus according to one embodiment of the present invention.

Moreover, the ink-jet recording head in each of the embodiments constitutes a part of a recording head unit provided with an ink passage that communicates with an ink cartridge and the like, and it is loaded on an ink-jet recording apparatus. FIG. 11 is a schematic illustration showing one example of the ink-jet recording apparatus.

As shown in FIG. 11, on recording head units 1A and 1B each having an ink-jet recording head, provided detachably are cartridges 2A and 2B that constitute ink supply means. And a carriage 3 that loads the recording head units 1A and 1B thereon is disposed on a carriage shaft 5 fixed to a main body 4 of the apparatus, as movably along the direction of the shaft. The recording head units 1A and 1B are provided, for example, for ejecting a black ink composition and a color ink composition.

The carriage 3 loading the recording head units 1A and 1B is moved along the carriage shaft 5 by driving force of a drive motor 6 being transferred to the carriage 3 via an unillustrated plurality of gears and a timing belt 7. Mean while, on the main body 4 of the apparatus, there is provided a platen 8 along the carriage 3. The platen 8 can rotate by driving force of an unillustrated paper feeding motor, and a recording sheet S as a recording medium, such as paper fed by a feeding roller or the like, is caught into the platen 8 and conveyed.

As described above, in the present invention, a piezoelectric active portion and a piezoelectric non-active portion are formed in a region facing a pressure generating chamber, and electrode wiring is provided as it extends from an upper electrode to and over peripheral walls. Also, protection layers are provided for protecting a vibration plate in a region facing an end portion in a longitudinal direction of the pressure generating chamber as well as a vibration plate in a region facing an end portion of a piezoelectric layer within a region facing the inside of the pressure generating chamber at an end portion opposite to the outgoing side of the electrode wiring of the pressure generating chamber. Accordingly, rigidity of the vibration plate at the end portions in the longitudinal direction of the pressure generating chamber is enhanced, whereby occurrence of cracks on the vibration plate caused by deformation due to drive of the piezoelectric element can be prevented.

What is claimed is:

1. An ink-jet recording head, comprising:

a pressure generating chamber that communicates with a nozzle orifice; and a piezoelectric element having a lower electrode, a piezoelectric layer and an upper electrode being provided in a region corresponding to the pressure generating chamber via a vibration plate, wherein there are provided within a region facing the pressure generating chamber a piezoelectric active portion as a substantial drive portion of the piezoelectric element and a piezoelectric non-active portions having the piezoelectric layer continuous from the piezoelectric active portion but not being substantially driven, the piezoelectric non-active portions being provided on both end portions of the piezoelectric active portion in a longitudinal direction thereof, an electrode wiring drawn out of the upper electrode is provided only on one end portion in the longitudinal direction of the pressure generating chamber, there is provided a protection layer only on the other end portion, wherein the protection layer is provided only in the other end portion, in the longitudinal direction of the pressure generating chamber for protecting the vibration plate being provided in a region facing an end portion of the pressure generating chamber and in region facing an end portion of the piezoelectric layer within the region facing the pressure generating chamber, and the protection layer is provided so as to cover a region facing a corner portion of the pressure generating chamber.

2. The ink-jet recording head according to claim 1, wherein said piezoelectric layer has crystals subjected to a priority orientation.

3. The ink-jet recording head according to claim 2, wherein said piezoelectric layer has crystals shaped in a columnar shape.

4. The ink-jet recording head according to claim 1, wherein a film thickness of said piezoelectric layer ranges from 0.5 to 3 $\mu$m.

5. The ink-jet recording head according to claim 1, wherein the protection layer is composed of the same material as the electrode wiring.

6. The ink-jet recording head according to claim 5, wherein the protection layer is provided so as to cover the end portion in the longitudinal direction of the piezoelectric non-active portion.

7. The ink-jet recording head according to claim 5, wherein the protection layer is provided as to extend beyond a boundary of the piezoelectric active portion and the piezoelectric non-active portion.

8. The ink-jet recording head according to claim 1, wherein the protection layer possesses higher rigidity than the lower electrode.

9. The ink-jet recording head according to claim 1, wherein the protection layer is also provided in a region facing one end portion of the pressure generating chamber.

10. The ink-jet recording head according to claim 9, wherein the electrode wiring doubles as a protection layer.

11. The ink-jet recording head according to claim 1, wherein the lower electrode is formed across a plurality of piezoelectric elements, a lower-electrode-removal portion is formed at each of the pressure generating chambers by removing the lower electrode on at least the end portion of the lower electrode opposite to the electrode wiring of the pressure generating chamber, and the protection layer is formed only within the lower-electrode-removal portion.

12. The ink-jet recording head according to claim 11, wherein the lower-electrode-removal portion has an approximately rectangular shape.

13. The ink-jet recording head according to claim 1, wherein the lower electrode is formed across a plurality of piezoelectric elements, and a lower-electrode-removal portion is formed continuously over a region corresponding to the plurality of pressure generating chambers by removing the lower electrode on at least the end portion of the lower electrode opposite to the electrode wiring of the pressure generating chamber.

14. The ink-jet recording head according to claim 1, wherein at least the piezoelectric layer constituting the piezoelectric element is formed independently within the region facing the pressure generating chamber.

15. The ink-jet recording head according to claim 14, wherein at least the piezoelectric non-active portion on the side of the other end portion in the longitudinal direction of the pressure generating chamber is formed by removing the lower electrode.

16. The ink-jet recording head according to claim 1, wherein the piezoelectric non-active portion on at least the other end portion in the longitudinal direction of the pressure generating chamber is provided in a manner extending to the outside of the region facing the pressure generating chamber to protect the vibration plate by eliminating the end portion of the piezoelectric layer within the region facing the pressure generating chamber, and a region of the piezoelectric non-active portion provided by extending to the outside of the region facing the pressure generating chamber constitutes a part of the protection layer.

17. The ink-jet recording head according to claim 16, wherein at least a width in the vicinity of a portion of the piezoelectric layer constituting the piezoelectric non-active portion, the portion which traverses a boundary of the end portion in the longitudinal direction of the pressure generating chamber and the peripheral wall, is wider than a width of the pressure generating chamber.

18. The ink-jet recording head according to claim 16, wherein at least the piezoelectric non-active portion on the side of the other end portion in the longitudinal direction of the pressure generating chamber is formed by removing the upper electrode.

19. The ink-jet recording head according to claim 1, wherein said pressure generating chamber is formed by subjecting a single crystal silicon substrate to anisotropic etching, and each layer of said piezoelectric element is formed of a thin film by a lithography method.

20. The ink-jet recording head according to claim 1, wherein a width of the protection layer gradually decreases toward a tip portion, such that the tip portion forms a triangular shape.

21. The ink-jet recording head according to claim 1, wherein the electrode wiring is provided on and extends from only one end portion of the upper electrode.

22. The ink-jet recording head according to claim 1, wherein the electrode wiring is distinct from and connected to the upper electrode.

23. The ink-jet recording head according to claim 1, wherein at least a portion of the protective layer is directly formed on the vibration plate.

24. An ink-jet recording apparatus comprising:

the ink-jet recording head according to any one of claims 1 to 10, 14, 15, 19 and 20.

* * * * *